US010071465B2

(12) United States Patent
Arisawa et al.

(10) Patent No.: US 10,071,465 B2
(45) Date of Patent: Sep. 11, 2018

(54) GRINDSTONE TOOL

(71) Applicant: MITSUBISHI HEAVY INDUSTRIES MACHINE TOOL CO., LTD., Ritto-shi, Shiga (JP)

(72) Inventors: Hideaki Arisawa, Tokyo (JP); Haruhiko Niitani, Tokyo (JP)

(73) Assignee: MITSUBSIHI HEAVY INDUSTRIES MACHINE TOOL CO., LTD., Shiga (JP)

( * ) Notice: Subject to any disclaimer, the term of this patent is extended or adjusted under 35 U.S.C. 154(b) by 100 days.

(21) Appl. No.: 14/424,960

(22) PCT Filed: Jun. 14, 2013

(86) PCT No.: PCT/JP2013/066432
§ 371 (c)(1),
(2) Date: Feb. 27, 2015

(87) PCT Pub. No.: WO2014/034226
PCT Pub. Date: Mar. 6, 2014

(65) Prior Publication Data

US 2015/0231764 A1 Aug. 20, 2015

(30) Foreign Application Priority Data

Aug. 29, 2012 (JP) ..... 2012-188357

(51) Int. Cl.
*B24D 5/10* (2006.01)

(52) U.S. Cl.
CPC ..... *B24D 5/10* (2013.01)

(58) Field of Classification Search
CPC ..... B24D 5/10; B24D 5/00; B24D 7/00
(Continued)

(56) References Cited

U.S. PATENT DOCUMENTS 6,896,600 B1 * 5/2005 Wu ..... B24B 21/04 222/420
8,696,252 B2 * 4/2014 Bonnarang ..... B23C 5/28 407/11

(Continued)

FOREIGN PATENT DOCUMENTS

GB 855283 A 11/1960
JP 52-29692 U 3/1977

(Continued)

OTHER PUBLICATIONS

Translated Patent Document, Yao Y, Nov. 2011.*

(Continued)

*Primary Examiner* — Monica Carter
*Assistant Examiner* — Lauren Beronja
(74) *Attorney, Agent, or Firm* — Birch, Stewart, Kolasch & Birch, LLP

(57) ABSTRACT

A grindstone tool is provided with a shaft part which has a tubular shape having a connection hole therein, a head part which has a cylindrical shape coaxially and integrally connected to the leading end of the shaft part and having a hollow section therein, and abrasive grains which adhere to the entire outer peripheral surface of the head part via a bonding material. A grinding fluid is supplied to the hollow section of the head part from one end side of the head part, the other end side of the head part is blocked by a lid member, and in the head part, a plurality of communication holes through which the hollow section and the outer peripheral surface communicate with each other, and which each have a taper shape with a diameter size on the outer peripheral surface side larger than a diameter size of the shaft center side are formed.

5 Claims, 10 Drawing Sheets

(58) Field of Classification Search
USPC ..... 451/466
See application file for complete search history.

(56) References Cited

U.S. PATENT DOCUMENTS

| | | | | |
|---|---|---|---|---|
| 2009/0221218 | A1 | 9/2009 | Le Borgne et al. | |
| 2011/0121564 | A1* | 5/2011 | Kaplan | F16L 27/047 285/263 |
| 2012/0198639 | A1* | 8/2012 | Smith | A46B 3/18 15/104.05 |

FOREIGN PATENT DOCUMENTS

| | | | |
|---|---|---|---|
| JP | 5-269669 | A | 10/1993 |
| JP | 05269669 | A * | 10/1993 |
| JP | 2007-144597 | A | 6/2007 |
| JP | 2008-155310 | A | 7/2008 |
| JP | 3166021 | U | 2/2011 |

OTHER PUBLICATIONS

International Preliminary Report on Patentability and Written Opinion of the International Searching Authority dated Mar. 12, 2015, for International Application No. PCT/JP2013/066432 with the English translation of the Written Opinion.
International Search Report dated Jul. 9, 2013, for International Application No. PCT/JP2013/066432 with the English translation.
Japanese Notice of Allowance, dated Dec. 1, 2015, for Japanese Application No. 2012-188357, with an English translation.
Extended European Search Report dated Apr. 19, 2016, for European Application No. 13832994.1.
Japanese Notification of Reasons for Refusal, dated Dec. 1, 2015, for Japanese Application No. 2012-188357, with an English translation.

* cited by examiner

GRINDSTONE TOOL

TECHNICAL FIELD

The present invention relates to a grinding wheel tool.

BACKGROUND ART

A grinding wheel tool is a disk-shaped or cylindrical core with many abrasive grains firmly attached to the outer surface thereof, and is capable of grinding a workpiece by rotating this core at a high speed and moving it relative to the workpiece by certain amounts of depth of cut and feed. In a case where this type of grinding wheel tool has a small abrasive grain size in order to improve the surface roughness of the ground surface of the workpiece, chip pockets (pores) to which cut chips escape are narrow and are easily clogged.

In view of this, Patent Literature 1 listed below, for example, proposes forming supply holes through which to supply grinding liquid in the outer surface of a core having abrasive grains firmly attached thereto, and sending the grinding liquid from inside the outer surface of the core to thereby suppress the occurrence of clogging.

CITATION LIST

Patent Literature

Patent Literature 1: Japanese Patent Application Publication 2007-144597

SUMMARY OF INVENTION

Technical Problem

Nevertheless, there is still a possibility that the grinding wheel tool described in Patent Literature 1 listed above, for example, may experience clogging in a case of high-feed machining or the like in which the amount of cut chips produced per unit time is large.

In view of the above, an object of the present invention is to provide a grinding wheel tool capable of greatly suppressing the occurrence of clogging even in a case of high-feed machining or the like in which the amount of cut chips produced per unit time is large.

Solution to Problem

A grinding wheel tool according to a first aspect of the invention for solving the above-mentioned problem is a grinding wheel tool, characterized in that the grinding wheel tool comprises: a cylindrical head part having a hollow section therein; and abrasive grains firmly attached to an entire outer peripheral surface of the head part, the hollow section of the head part is supplied with a fluid from one end side of the head part and is closed on another end side of the head part, and a plurality of communication holes are formed in the head part, each of the communication holes being a hole through which the hollow section and the outer peripheral surface communicate with each other and which is larger in diameter size on the outer peripheral surface side than on an axis side.

A grinding wheel tool according to a second aspect of the invention is the first aspect of the invention, characterized in that the grinding wheel tool further comprises a plug member which is fitted to the hollow section of the head part in such a way as to fill an inside of the hollow section, and in which connection holes for connecting the other end side of the head part and the communication holes are formed.

A grinding wheel tool according to a third aspect of the invention is the second aspect of the invention, characterized in that the plug member is made of any one of a metal and a resin having high rigidity.

A grinding wheel tool according to a fourth aspect of the invention is a grinding wheel tool, characterized in that the grinding wheel tool comprises: a cylindrical head part having a hollow section therein; and abrasive grains firmly attached to an entire outer peripheral surface of the head part, the hollow section of the head part has a tapered shape which is smaller in diameter size on one end side of the head part than on another end side of the head part, and the hollow section is supplied with a fluid from the one end side of the head part and discharges the fluid from the other end side of the head part, and a plurality of communication holes through which the hollow section and the outer peripheral surface communicate with each other are formed in the head part.

A grinding wheel tool according to a fifth aspect of the invention is the fourth aspect of the invention, characterized in that each of the communication holes of the head part is larger in diameter size on an axis side of the head part than on the outer peripheral surface side of the head part.

A grinding wheel tool according to a sixth aspect of the invention is the fourth or fifth aspect of the invention, characterized in that an axis of each of the communication holes of the head part is inclined with respect to an axis of the hollow section of the head part such that an opening of the communication hole on an axis side of the head part is situated closer to the other end side of the head part than is an opening of the communication hole on the outer peripheral surface side of the head part.

Advantageous Effect of Invention

According to the grinding wheel tools according to the present invention, it is possible to greatly suppress the occurrence of clogging even in a case of high-feed machining or the like in which the amount of cut chips produced per unit time is large.

DESCRIPTION OF EMBODIMENTS

Embodiments of a grinding wheel tool according to the present invention will be described with reference to the drawings. However, the present invention is not limited only to the embodiments to be described below with reference to the drawings.

First Embodiment

A first embodiment of the grinding wheel tool according to the present invention will be described with reference to FIGS. 1 to 4.

Figure 1:
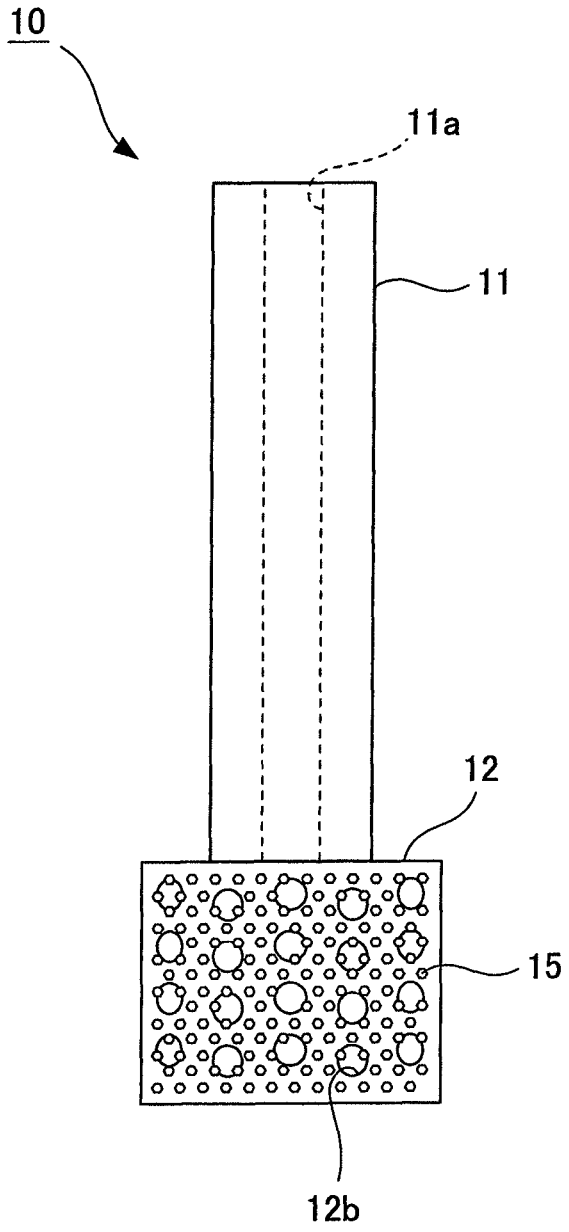
FIG. 1 is a schematic structure diagram of a first embodiment of a grinding wheel tool according to the present invention.
Figure 2:
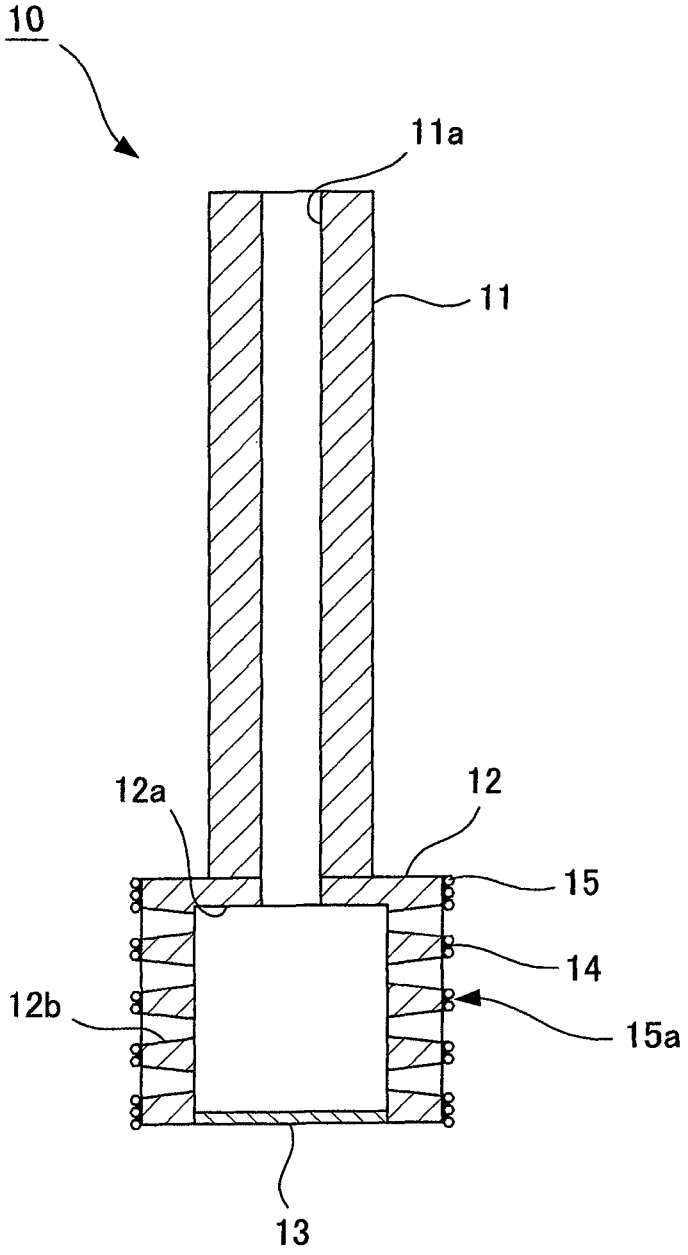
FIG. 2 is a cross-sectional view of the grinding wheel tool in FIG. 1 taken along the axis thereof.

As shown in FIGS. 1 and 2, one end side (upper side in FIGS. 1 and 2) of a cylindrical head part 12 having a hollow section 12*a* therein is integrally and coaxially joined to a tip side (lower side in FIGS. 1 and 2) of a tubular shaft part 11 having a passage hole 11*a* therein, the hollow section 12*a* being connected to the passage hole 11*a* of the shaft part 11. This head part 12 is larger in diameter than the shaft part 11. A lid member 13 for closing the other end side (lower side in FIGS. 1 and 2) of the hollow section 12*a* of the head part 12 is fitted to the other end side of the hollow section 12*a*.

In the head part 12, multiple communication holes 12*b* through which the hollow section 12*a* and the outer peripheral surface of the head part 12 communicate with each other are formed at predetermined intervals in the circumferential direction and the axial direction of the head part 12. Each communication hole 12*b* has a tapered shape (circular cone shape) so as to become larger in diameter size from the axis side of the head part 12 toward the outer peripheral surface side of the head part 12.

Abrasive grains 15 are firmed attached to the outer peripheral surface of the head part 12 with a bonding material 14 made of Ni plating obtained by electrodeposition, the abrasive grains 15 being attached over the entire outer peripheral surface without closing the communication holes 12*b*. Note that reference sign 15*a* in FIG. 2 denotes a chip pocket (pore) between the abrasive grains 15.

Figure 3:
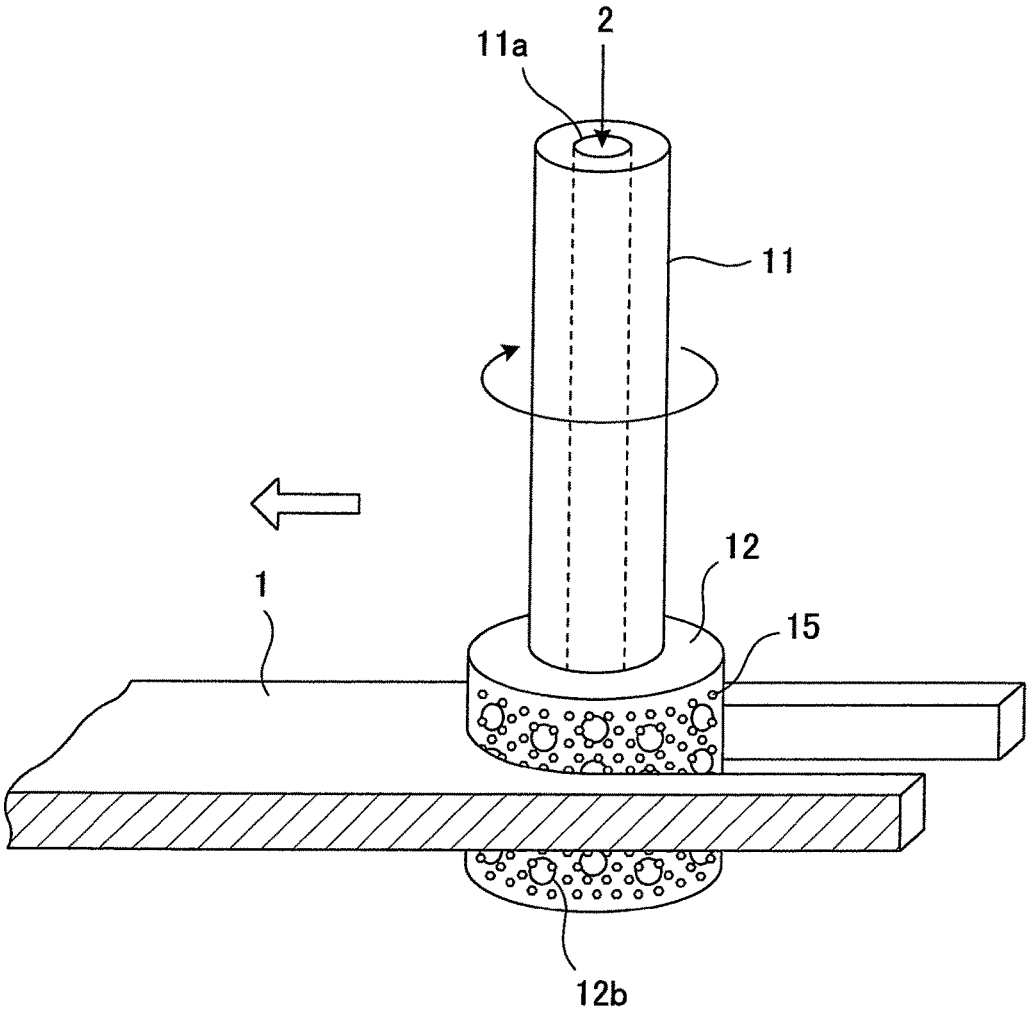
FIG. 3 is an explanatory diagram of operation of the grinding wheel tool in FIG. 1.
Figure 4:
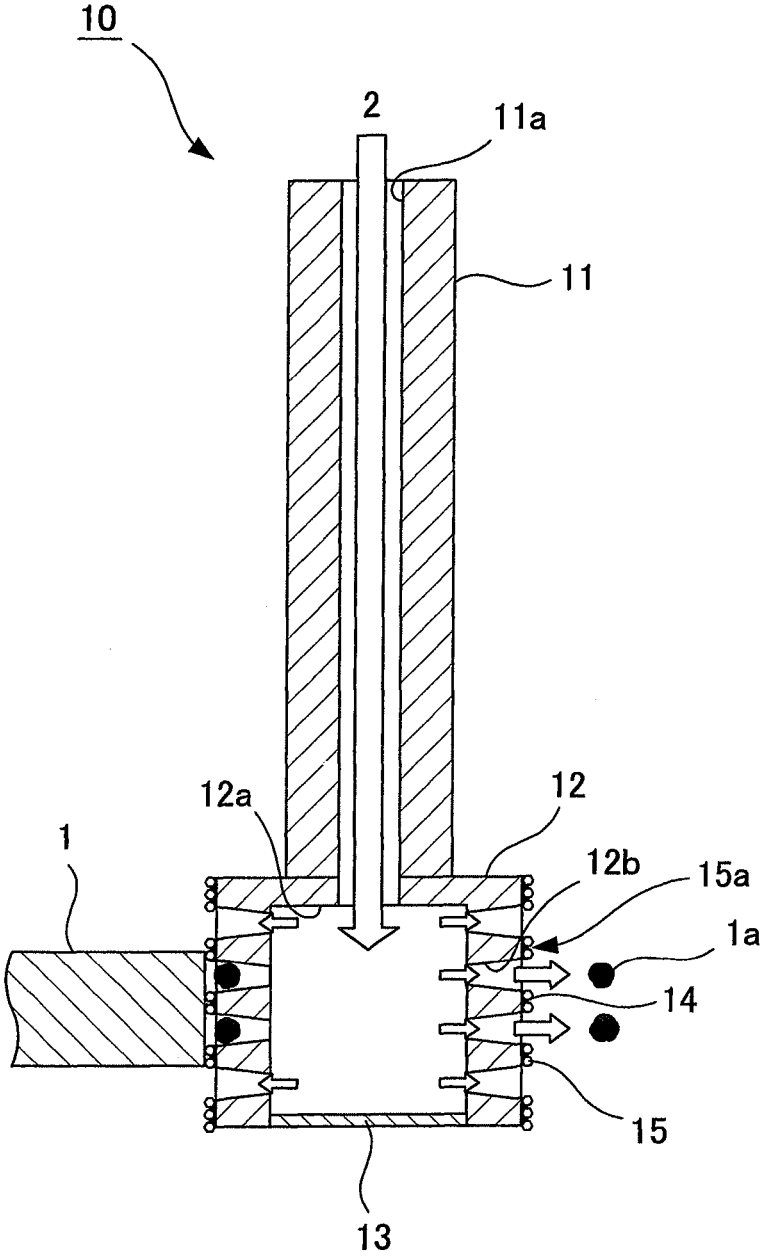
FIG. 4 is a cross-sectional view of the grinding wheel tool in FIG. 3 taken along the axis thereof.

A grinding wheel tool 10 according to this embodiment includes a core made of a metal such as carbon steel (S45C, S48C, SCM415, etc.) and formed of the shaft part 11, the head part 12, and the lid member 13 as described above, as well as the abrasive grains 15 firmly attached with the bonding material 14. As shown in FIG. 3, the grinding wheel tool 10 is moved relative to a workpiece 1 by certain amounts of depth of cut and feed with the head part 12 rotated through the shaft part 11 at a high speed and also with grinding liquid 2, which is a fluid, supplied into the passage hole 11*a* of the shaft part 11. As a result, as shown in FIG. 4, the abrasive grains 15 grind the workpiece 1 while the grinding liquid 2 is supplied into the hollow section 12*a* of the head part 12 from the one end side and flows out to the outer peripheral surface side from the communication holes 12*b*.

Here, those communication holes 12*b* of the head part 12 in contact with the workpiece 1 are covered by the workpiece 1. Thus, the grinding liquid 2 hardly flows out from them, and cut chips 1*a* produced from the workpiece 1 are led from the corresponding chip pockets 15*a* to the inside and stored there.

On the other hand, those communication holes 12*b* out of contact with the workpiece 1 allow the grinding liquid 2 to flow out therefrom, and also the cut chips 1*a* stored inside the communication holes 12*b* when they are in contact with the workpiece 1 are discharged to the outside by the outward flow of the grinding liquid 2.

In sum, the grinding wheel tool 10 according to this embodiment is configured such that when a region of the head part 12 comes into contact with the workpiece 1 to grind the workpiece 1, the cut chips 1*a* in the corresponding chip pockets 15*a* are led into the corresponding communication holes 12*b* and temporarily stored there and, when the region of the head part 12 is detached from the workpiece 1 and comes out of contact with the workpiece 1, the cut chips 1*a* stored in the communication holes 12*b* are forcibly discharged from the communication holes 12*b* to the outside by the grinding liquid 2.

In this way, the grinding wheel tool 10 according to this embodiment can ensure that the cut chips 1*a* are discharged to the outside without clogging the chip pockets 15*a*, even when the size of the abrasive grains is small and the chip pockets 15*a* are narrow.

Thus, the grinding wheel tool 10 according to this embodiment can greatly suppress the occurrence of the clogging even in a case of high-feed machining or the like in which the amount of cut chips 1*a* produced per unit time is large.

Moreover, the communication holes 12*b* of the head part 12 have a tapered shape (circular cone shape) which is larger in diameter size on the outer peripheral surface side of the head part 12 than on the axis side of the head part 12; thus, it is possible to lower the possibility that the cut chips 1*a* stored in the communication holes 12*b* may enter the hollow section 12*a*, and also to ensure that the cut chips 1*a* stored in the communication holes 12*b* are discharged to the outside without clogging the communication holes 12*b*.

Figure 5:
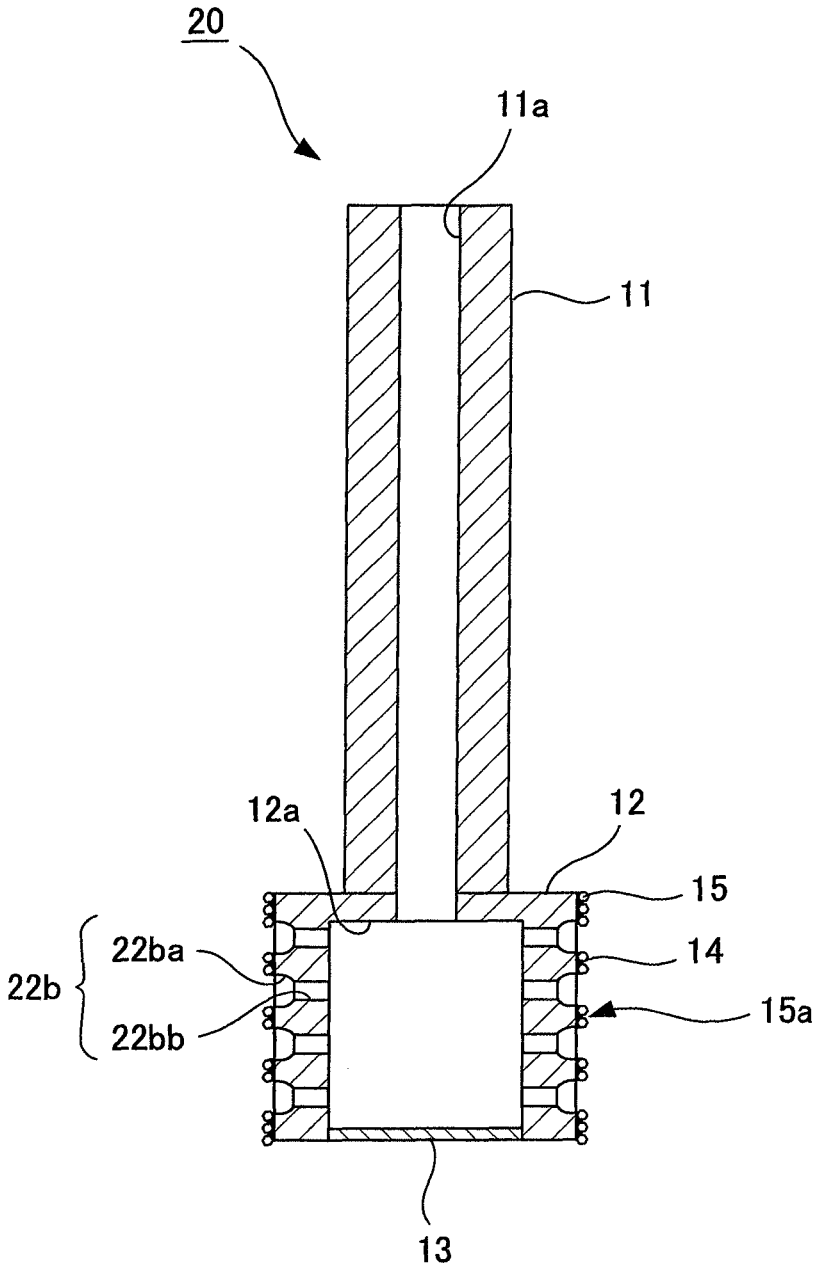
FIG. 5 is a cross-sectional view of another example of the first embodiment of the grinding wheel tool according to the present invention taken along the axis thereof.

Here, in this embodiment, the grinding wheel tool 10 is described which has the communication holes 12*b* having a tapered shape (circular cone shape) which becomes larger in diameter size from the axis side of the head part 12 toward the outer peripheral surface side of the head part 12; however, as shown in FIG. 5, for instance, a grinding wheel tool 20 having communications holes 22*b* each of which is larger in diameter size on the outer peripheral surface side of the head part 12 than on the axis side of the head part can be made as another example by forming semi-spherical dents 22*ba* on the outer peripheral surface side of the head part 12 and also forming holes 22*bb* which are smaller in diameter size than the dents 22*ba* and through which the dents 22*ba* and the hollow section 12*a* communicate with each other.

Figure 6:
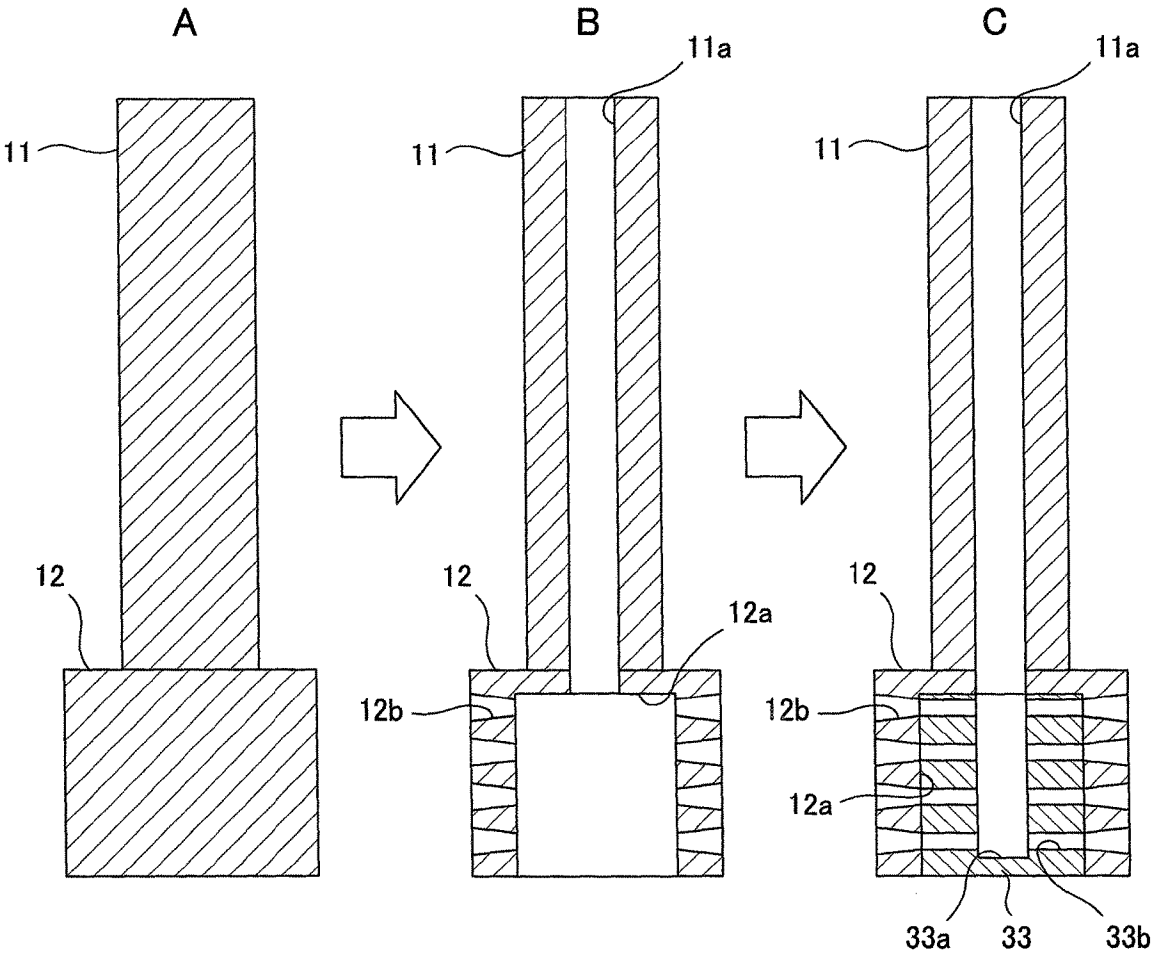
FIG. 6 is a cross-sectional view of still another example of the first embodiment of the grinding wheel tool according to the present invention taken along the axis thereof.

Still alternatively, as shown in FIG. 6, for instance, the rigidity of the head part 12 can be increased by forming, in the shaft part 11 and the head part 12 (see FIG. 6A), the passage hole 11*a*, the hollow section 12*a*, and the communication holes 12*b* (see FIG. 6B), and arranging a plug member 33 in place of the lid member 13 to thereby form a core (see FIG. 6C), the plug member 33 being made of a metal such as carbon steel (S45C, S48C, SCM415, etc.), having such a size as to be fitted in the hollow section 12*a* and fill the inside of the hollow section 12*a*, and having connection holes 33*a* and 33*b* formed in such a way as to connect the communication holes 12*b* and the passage hole 11*a* of the shaft part 11.

Here, it is preferable to make the plug member 33 from, for example, a resin having high rigidity (e.g. acrylonitrile-butadiene-styrene (ABS) resin, polyether-ether-ketone (PEEK) resin, "MC NYLON (registered trademark)" of Quadrant Polypenco Japan Ltd., etc.). In this way, the core can be made lighter in weight.

Second Embodiment

A second embodiment of the grinding wheel tool according to the present invention will be described with reference to FIGS. 7 and 8. Note that the same reference signs as those used in the description of the above embodiment will be used for the same portions as those in the above embodiment, and description overlapping the description in the above embodiment will be omitted.

Figure 7:
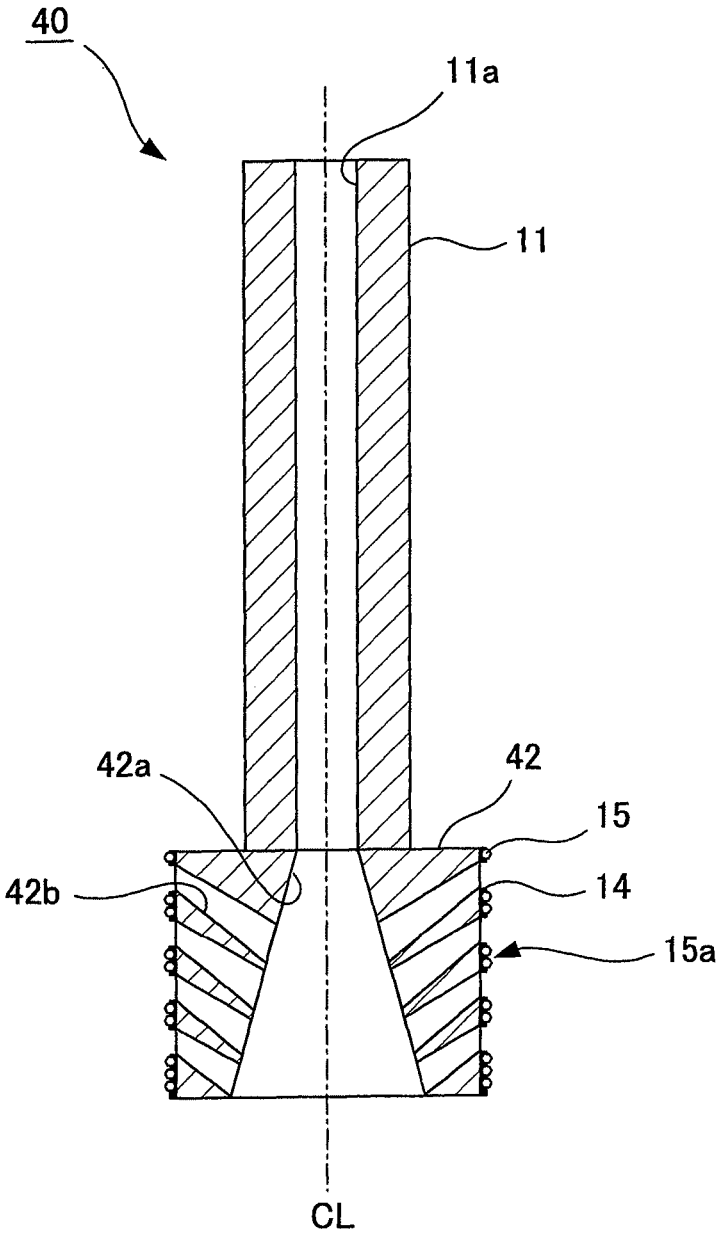
FIG. 7 is a cross-sectional view of a second embodiment of the grinding wheel tool according to the present invention taken along the axis thereof.
Figure 8:
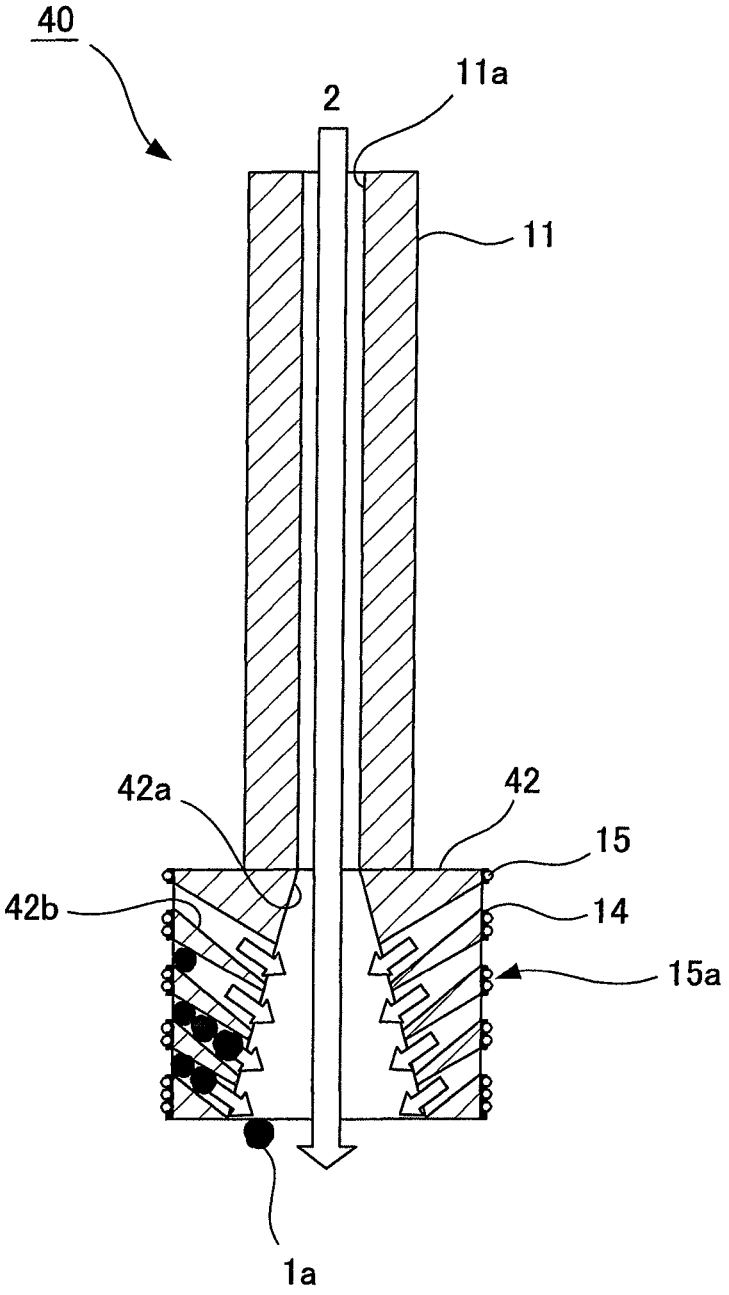
FIG. 8 is an explanatory diagram of operation of the grinding wheel tool in FIG. 7.

As shown in FIG. 7, one end side (upper side in FIG. 7) of a cylindrical head part 42 having a hollow section 42*a* therein is integrally and coaxially joined to the tip side (lower side in FIG. 7) of the shaft part 11, the hollow section 42*a* being connected to the passage hole 11*a* of the shaft part 11. The hollow section 42*a* of the head part 42 has a tapered shape (circular cone shape) which becomes larger in diameter size from the one end side (upper side in FIG. 7) of the head part 42 toward the other end side (lower side in FIG. 7) of the head part 42. In addition, the hollow section 42*a* is not closed but opened on the other end side of the head part 42.

In the head part 42, multiple communication holes 42*b* through which the hollow section 42*a* and the outer peripheral surface of the head part 42 communicate with each other are formed at predetermined intervals in the circumferential direction and the axial direction of the head part 42. Each communication hole 42*b* has a tapered shape (circular cone shape) so as to become larger in diameter size from the outer peripheral surface side of the head part 42 toward the axis side of the head part 42. Moreover, the axis of the communication hole 42*b* is inclined with respect to the axis of the hollow section 42*a* of the head part 42 such that the opening of the communication hole 42*b* on the axis side of the head part 42 is situated closer to the other end side (lower side in FIG. 7) of the head part 42 than is the opening of the communication hole 42*b* on the outer peripheral surface side of the head part 42.

A grinding wheel tool 40 according to this embodiment includes a core made of a metal such as carbon steel (S45C, S48C, SCM415, etc.) and formed of the shaft part 11 and the head part 42 as describe above. The grinding wheel tool 40 is moved relative to a workpiece 1 by certain amounts of depth of cut and feed with the head part 42 rotated through the shaft part 11 at a high speed and also with grinding liquid 2, which is a fluid, supplied into the passage hole 11*a* of the shaft part 11. In addition, the grinding liquid 2 is supplied also to the portion in contact with the workpiece 1. As a result, as shown in FIG. 8, the abrasive grains 15 grind the workpiece 1 while the grinding liquid 2 supplied into the passage hole 11*a* of the shaft part 11 is supplied into the hollow section 42*a* of the head part 42 from the one end side (upper side in FIG. 8), flows through the hollow section 42*a*, and is discharged to the outside from the other end side (lower side in FIG. 8) of the head part 42.

Here, the inside of the communication holes 42*b* of the head part 42 is sucked from inside the hollow section 42*a* by the flow of the grinding liquid 2. Accordingly, cut chips 1*a* produced from the workpiece 1 are sucked from the chip pockets 15*a* into the communication holes 42*b* of the head part 42 and sent into the hollow section 42*a*. The cut chips 1*a* sent into the hollow section 42*a* are then discharged to the outside from the other end side (lower side in FIG. 8) of the head part 42 along with the grinding liquid 2.

In sum, in the case of the grinding wheel tools 10 and 20 according to the above embodiment, when regions of the head parts 12 and 13 come into contact with the workpiece 1 to grind the workpiece 1, the cut chips 1*a* in the corresponding chip pockets 15*a* are led into the corresponding communication holes 12*b* and 22*b* and temporarily stored there and, when the regions are detached from the workpiece 1 and come out of contact with the workpiece 1, the cut chips 1*a* stored in the communication holes 12*b* and 22*b* are forcibly discharged from the communication holes 12*b* and 22*b* to the outside by the grinding liquid 2; on the other hand, in the case of the grinding wheel tool 40 according to this embodiment, when a region of the head part 42 comes into contact with the workpiece 1 to grind the workpiece 1, the cut chips 1*a* in the chip corresponding pockets 15*a* are sucked into the corresponding communication holes 42*b*, sent into the hollow section 42*a*, and discharged to the outside from the other end side of the head part 42.

In this way, like the grinding wheel tools 10 and 20 according to the above embodiment, the grinding wheel tool 40 according to this embodiment can ensure that the cut chips 1*a* are discharged to the outside without clogging the chip pockets 15*a*, even when the size of the abrasive grains is small and the chip pockets 15*a* are narrow.

Thus, like the grinding wheel tools 10 and 20 according to the above embodiment, the grinding wheel tool 40 according to this embodiment can greatly suppress the occurrence of the clogging even in a case of high-feed machining or the like in which the amount of cut chips 1*a* produced per unit time is large.

Moreover, the hollow section 42*a* of the head part 42 has a tapered shape (circular cone shape) so as to become larger in diameter size from the one end side (upper side in FIG. 7) of the head part 42 toward the other end side (lower side in FIG. 7); thus, the strength of suction from the inside of the communication holes 42*b* to the inside of the hollow section 42*a* can be increased. This makes it possible to enhance the performance of suction of the cut chips 1*a* into the communication holes 42*b* and also to ensure that the cut chips 1*a* are discharged to the outside from the other end side of the head part 42 without clogging the hollow section 42*a*.

Further, each of the communication holes 42*b* of the head part 42 is larger in diameter size on the axis side of the head part 42 than on the outer peripheral surface side of the head part 42; thus, it is possible to ensure that the cut chips 1*a* sucked into the communication holes 42*b* are sent into the hollow section 42*a* without clogging the communication holes 42*b*.

Furthermore, the axis of each communication hole 42*b* of the head part 42 is inclined with respect to the axis of the hollow section 42*a* of the head part 42 such that the opening of the communication hole 42*b* on the axis side of the head part 42 is situated closer to the other end side (lower side in FIG. 7) of the head part 42 than is the opening of the communication hole 42*b* on the outer peripheral surface side of the head part 42; thus, it is possible to greatly lower the possibility that the grinding liquid 2 and the cut chips 1*a* flowing through the hollow section 42*a* of the head part 42 from the one end side toward the other end side may flow into the communication hole 42*b*.

Figure 9:
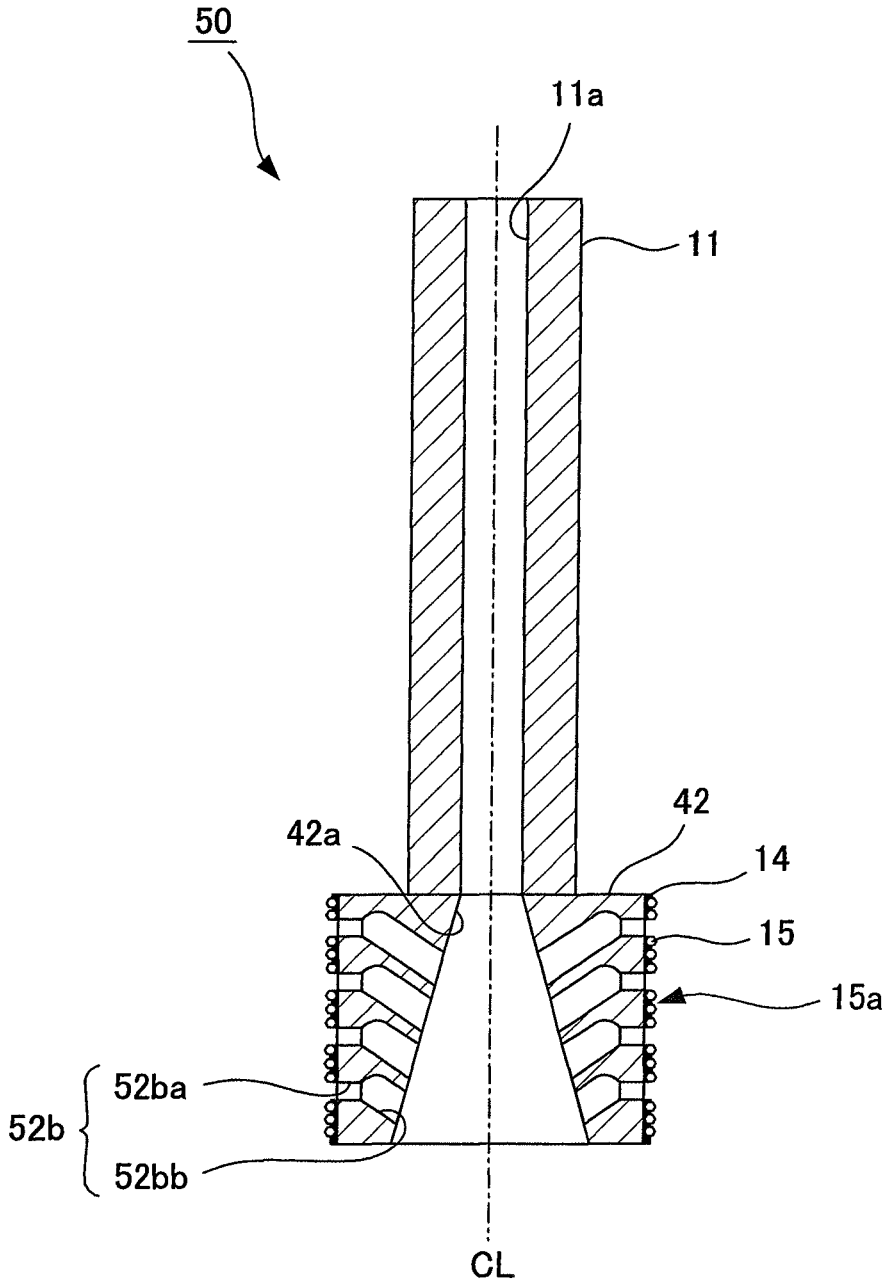
FIG. 9 is a cross-sectional view of another example of the second embodiment of the grinding wheel tool according to the present invention taken along the axis thereof.

Here, in this embodiment, the grinding wheel tool 40 is described which has the communication holes 42*b* each having a tapered shape (circular cone shape) that becomes larger in diameter size from the outer peripheral surface side of the head part 42 toward the axis side of the head part 42; however, as shown in FIG. 9, for instance, a grinding wheel tool 50 having communications holes 52*b* each of which is larger in diameter size on the axis side of the head part 42 than on the outer peripheral surface side of the head part 42 can be made as another example by forming cylindrical holes 52*ba* on the outer peripheral surface side of the head part 42 and also forming holes 52*bb* which are larger in diameter size than the holes 52*ba* and through which the holes 52*ba* and the hollow section 42*a* communicate with each other.

Figure 10:
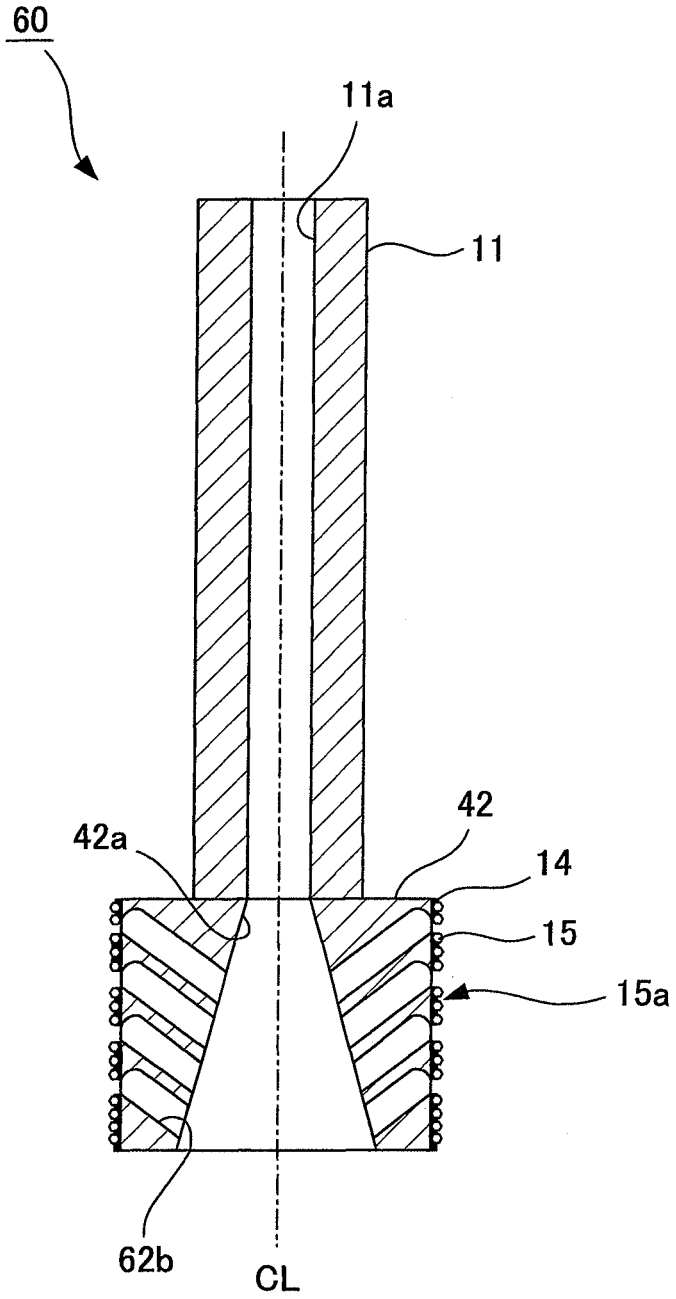
FIG. 10 is a cross-sectional view of still another example of the second embodiment of the grinding wheel tool according to the present invention taken along the axis thereof.

Still alternatively, as shown in FIG. 10, for instance, it is possible to make a grinding wheel tool 60 having communication holes 62*b* each of which is larger in diameter size on the axis side of the head part 42 than on the outer peripheral surface side of the head part 42, the communication holes 62*b* being formed by cutting the head part 42 from the hollow section 42*a* side toward the outer peripheral surface side of the head part 42 with a ball end mill and stopping the cutting when the tip of the ball end mill slightly penetrates the outer peripheral surface of the head part 42.

Other Embodiments

Note that in the above first and second embodiments, the grinding wheel tools 10, 20, and 40 including the head parts 12 and 42 which are larger in diameter than the shaft part 11 are described, but the present invention is not limited to these cases. Advantageous effects similar to those by the above embodiments can be achieved even by a grinding wheel tool including a head part which is equal in diameter to a shaft part or smaller in diameter than the shaft part.

Moreover, in the above first and second embodiments, the grinding liquid 2 is used, but the present invention is not limited to this case. As other embodiments, it is possible to use a different liquid such as water, a gas such as air, for example.

INDUSTRIAL APPLICABILITY

The grinding wheel tool according to the present invention can greatly suppress the occurrence of clogging even in a case of high-feed machining or the like in which the amount of cut chips produced per unit time is large, and can therefore be utilized significantly beneficially in the metal-working industry and other similar industries.

REFERENCE SIGNS LIST

1 WORKPIECE
1*a* CUT CHIP
2 GRINDING LIQUID
10 GRINDING WHEEL TOOL
11 SHAFT PART
11*a* CONNECTING HOLE
12 HEAD PART
12*a* HOLLOW SECTION
12*b* COMMUNICATION HOLE
13 LID MEMBER
14 BONDING MATERIAL
15 ABRASIVE GRAIN
15*a* CHIP POCKET (PORE)
20 GRINDING WHEEL TOOL
22*b* COMMUNICATION HOLE
22*ba* DENT
22*bb* HOLE
33 PLUG MEMBER
33*a*, 33*b* CONNECTION HOLE
40 GRINDING WHEEL TOOL
42 HEAD PART
42*a* HOLLOW SECTION
42*b* COMMUNICATION HOLE
50 GRINDING WHEEL
52*b* COMMUNICATION HOLE
52*ba* HOLE
52*bb* HOLE
60 GRINDING WHEEL TOOL
62*b* COMMUNICATION HOLE

The invention claimed is:

1. A grinding wheel tool, comprising:

a shaft part having a passage hole which is arranged along a longitudinal direction of the shaft part;

a cylindrical head part having a plate portion which has one surface joined to the shaft part and a tube portion extending along a rotation axis of the grinding wheel tool from an other surface of the plate portion opposite to the one surface, the plate portion defining an opening, the tube portion defining a hollow section therein and having an open end, the hollow section being in communication with the passage hole through the opening;

abrasive grains attached to an outer peripheral surface of the head part;

a plurality of communication holes extending in a radial direction is formed in the tube portion, each of the communication holes extending from the hollow section to the outer peripheral surface of the tube portion, a diameter of a communication hole at an outer peripheral surface side being larger than a diameter at a hollow section side; and a plug member fitted to the hollow section of the tube portion a first end of the plug member opposes the other surface of the plate portion and a second end of the plug member closes the open end, and having a passage connected to the hollow section and connection holes that connect the passage and the communication holes, wherein each of the connection holes extends between an inner surface and an outer surface of the plug member, and a communication hole and a connection hole form a straight passage that extends between an inner surface of the plug member and an outer surface of the tube portion.

2. The grinding wheel tool according to claim 1, wherein the plug member is made of any one of a metal and a resin having high rigidity.

3. A grinding wheel tool, comprising:

a cylindrical head part having a hollow section therein; and abrasive grains attached to an outer peripheral surface of the head part, wherein the hollow section of the head part is arranged along a rotation axis of the head part, and has a tapered shape which is smaller in diameter on one end side of the head part than on an other end side of the head part, and the hollow section being configured to supply a fluid into the hollow section from the one end side of the head part and discharge the fluid from the other end side of the head part, and a plurality of communication holes through which the hollow section and the outer peripheral surface communicate with each other are formed in the head part, wherein supply and discharge of the fluid causes cut chips inside of the plurality of communication holes to be sucked from inside the hollow section of the head part.

4. The grinding wheel tool according to claim 3, wherein each of the communication holes of the head part is larger in diameter at a rotation axis side of the head part than at the outer peripheral surface side of the head part.

5. The grinding wheel tool according to claim 3, wherein an axis of each of the communication holes of the head part is inclined with respect to the rotation axis of the head part such that an opening of the communication hole at the rotation axis side of the head part is situated closer to the other end side of the head part than an opening of the communication hole at the outer peripheral surface side of the head part.

* * * * *